United States Patent [19]

Holmes

[11] Patent Number: 4,730,543

[45] Date of Patent: Mar. 15, 1988

[54] CLOSED CENTER HYDRAULIC VALVE CONTROL SYSTEM FOR AERIAL LIFT

[75] Inventor: William K. Holmes, Delafield, Wis.

[73] Assignee: Hi-Ranger, Inc., Waukesha, Wis.

[21] Appl. No.: 903,507

[22] Filed: Sep. 4, 1986

Related U.S. Application Data

[63] Continuation-in-part of Ser. No. 745,514, Jun. 17, 1985, abandoned.

[51] Int. Cl.[4] ..... F15B 11/08

[52] U.S. Cl. ..... 91/448; 91/51; 91/444; 91/461; 137/596.12; 137/625.6; 137/513.5; 212/162

[58] Field of Search ..... 60/413; 91/461, 51, 91/424, 448, 445, 459, 527; 137/596.12, 625.6, 513.5; 212/160, 162, 163

[56] References Cited

U.S. PATENT DOCUMENTS

| | | | |
|---|---|---|---|
| 2,946,196 | 7/1960 | Myers | 60/573 |
| 3,340,897 | 9/1967 | Nevulis | 212/162 X |
| 3,805,674 | 4/1974 | Sebesta et al. | 91/461 |
| 3,931,830 | 1/1976 | Gritz | 137/513.5 |
| 4,350,078 | 9/1982 | Olofsson | 91/461 X |
| 4,427,121 | 1/1984 | Clements | 212/160 X |
| 4,487,106 | 12/1984 | Field | 91/527 X |
| 4,508,014 | 2/1985 | Shoff | 137/596.12 |
| 4,509,406 | 4/1985 | Melocik | 91/461 X |
| 4,542,768 | 9/1985 | Harris | 137/513.5 |

*Primary Examiner*—Edward K. Look

*Attorney, Agent, or Firm*—Michael, Best & Friedrich

[57] ABSTRACT

Apparatus for controlling operation of an aerial lift having a boom. A hydraulic fluid pump is connected to a hydraulic cylinder, and the control arrangement controls the supply of hydraulic fluid from the hydraulic fluid pump to the cylinder and controls the supply of hydraulic fluid pressure to a first pilot fluid port and to a second pilot fluid port of a pilot operated control valve to control operation of the pilot operated control valve. A first hydrulic fluid conduit operably connects the hydraulic fluid pump to a first pilot fluid port, and a second hydraulic fluid conduit operably connects the hydraulic fluid pump to a second pilot fluid port of said control valve. A control handle selectively vents hydraulic fluid from the first fluid conduit and the second fluid conduit to control fluid pressure at the pilot ports.

14 Claims, 5 Drawing Figures

CLOSED CENTER HYDRAULIC VALVE CONTROL SYSTEM FOR AERIAL LIFT

CROSS-REFERENCE TO RELATED APPLICATION

This application is a continuation-in-part of U.S. application Ser. No. 745,514, filed June 17, 1985, now abandoned.

FIELD OF THE INVENTION

The invention relates to aerial lifts of the type including boom and hydraulic cylinders for controlling extension and movement of the boom and to hydraulic controls of the type for use in controlling operation of a boom.

BACKGROUND PRIOR ART

Aerial lifts of the type including a bucket supported by a boom commonly include a hydraulic control handle supported by the bucket for use by an operator in a bucket for controlling a plurality of hydraulic control valves at the base of the boom. An example of such an aerial lift is illustrated in the Myers U.S. Pat. No. 2,946,196, issued July 26, 1960 and assigned to the assignee of the present invention. As illustrated there, it is common that the aerial lift will include three pilot operated main control valves for use in controlling operation of a pair of hydraulic cylinders provided to cause extension of the boom and a rotary actuator which functions to cause rotation of the articulated boom about the central vertical axis. The control handle in the bucket is connected by a plurality of hydraulic fluid lines to the three pilot operated main control valves. The control handle can be moved in three different directions, and means are provided such that movement of the control handle forward and back in one direction will control operation of one of the main control valves, movement of the control handle up and down will control a second one of the main control valves, and twisting movement of the control handle will cause operation of the third one of the main control valves. The control handle includes a plurality of hydraulic pistons which move in response to movement of the control handle. Movement of the control handle and consequent movement of the pistons functions to cause a change in the hydraulic fluid Pressure in the hydraulic fluid lines connected to the control valves.

One of the problems with such prior art arrangements is that any change in oil pressure at the pilot operated control valves requires the operator to manually move the control handle to manually pump hydraulic fluid through the hydraulic fluid lines. In the preferred case, the control handle should provide precise control over the boom with a minimal amount of physical effort by the operator. In those applications where the articulated boom is very long, the hydraulic fluid lines must also be very long, and there may be substantial frictional losses between the bucket and the valves at the base of the boom. Where there are such fluid pressure losses, precise control of the boom is more difficult because movement of the control handle requires greater effort by the operator. In such applications where the articulated boom is quite long, it is of even greater importance that the control mechanism provide precise control, since a small signal to the hydraulic cylinders or rotary actuator will produce a substantial movement of the operator's bucket.

In the prior art arrangements, the force the operator must exert on the control handle also increases in cold weather due to changes in the viscosity of the hydraulic fluid.

Efficient operation of the prior art hydraulic control arrangements also requires an absence of leaks in the fluid lines between the control handle at the end of the boom and the control valves at the base of the articulated boom. The hydraulic system functions because of the incompressability of the hydraulic fluid in the system. If there are leaks in the system, the hydraulic controls become less effective as a means for accurately controlling the position of the bucket. The fluid lines must remain full of hydraulic fluid so that movement of the pistons connected to the control handle to cause a change in hydraulic fluid pressure in the fluid pressure lines at the bucket will also cause a similar change in the hydraulic fluid pressure at the pilot operated control valve.

SUMMARY OF THE INVENTION

The present invention provides an improved apparatus for controlling the operation of a boom of an aerial lift or the like and including an improved means for supplying hydraulic fluid to the pilot ports of the pilot operated control valves of an aerial lift. The aerial lift includes a boom adapted to be supported by a truck frame for rotation about a central vertical axis. A hydraulic motor provides selective rotation of the boom about the vertical axis, and at least one hydraulic cylinder is Provided for controlling extension of the boom. A plurality of pilot operated hydraulic control valves are provided at the base of the boom for controlling operation of the hydraulic motor and hydraulic cylinder. Each pilot operated control valve includes a valve body having a valve bore housing a shiftable valve spool. Pilot ports are Provided at opposite ends of each valve spool to control movement of the valve spool.

Means are also provided for selectively supplying hydraulic fluid pressure to the pilot ports at opposite ends of the pilot operated valves to control operation of the valves. The means for supplying hydraulic fluid includes a control handle mounted on the bucket supported by an upper end of the boom, and means responsive to movement of the control handle for controlling the supply of hydraulic fluid to the opposite ends of the pilot operated valves. Each pilot operated valve is connected to a source of hydraulic fluid pressure by a first fluid line and a second fluid line. Means are also provided for selectively venting hydraulic fluid from the first and second fluid lines to control the fluid pressure supplied to the oppcsite ends of the pilot operated valve. The means for venting includes a pair of fluid relief ports, one of the fluid relief ports being connected to the first fluid line, and the other of the fluid relief ports being connected to the second fluid line. The fluid relief ports each include a valve body having a valve seat and a valve member moveable toward and away from the valve seat for controlling the amount of hydraulic fluid vented. The valve members are connected to the control handle such that movement of the control handle from the neutral position will cause an increase in the hydraulic fluid vented through one fluid relief port and a decrease in the amount of fluid vented through the other fluid relief port. Such movement of the control handle will thus change the hydraulic fluid pressure in the first and second fluid lines and control the fluid pressure on the opposite ends of the pilot operated control valve. In a preferred form of the invention, springs are provided between the valve members and the control handle such that the force applied on the valve member biasing it toward the valve seat is directly proportional to the movement of the control handle.

One of the principal advantages of the control system embodying the invention is that it comprises a closed center hydraulic system, rather than a flow through center system. The control system requires relatively little effort on the control handle in the bucket to provide for operation of a control valve at the base of the articulated boom.

Another advantage of the control system embodying the invention is that it facilitates the inclusion of a relatively simple deadman control and provides a safe operating system for controlling the articulated boom.

Another advantage of the invention is that the control arrangement can permit substantial movement of the control handle while producing only a small change in the position of the valve, and the control handle can thus provide precise control of the control valve. Additionally, movement of the control handle can be linearly proportional to the change in the fluid pressure in the hydraulic fluid lines.

An additional feature of the invention is that the hydraulic circuit of the control means can be constructed such that foreign matter suddenly blocking one of the bleed ports will not cause sudden movement of the bucket supported by the articulated boom. The construction of the hydraulic control system facilitates the provision of an electrically operated deadman control such that the control valves are operable and hydraulic fluid flows through the bleed ports only when the operator grips the control handle and actually controls the position of the bucket.

Another advantage of the invention is that in the event the control handle in the bucket becomes jammed or otherwise inoperative, a control override handle connected to the valve spools can easily cause controlled movement of the valve spools overriding the pilot pressure on the valve spools.

Various features of the invention will be apparent from the following description of a preferred embodiment, from the claims and from the drawings.

Figure 1:
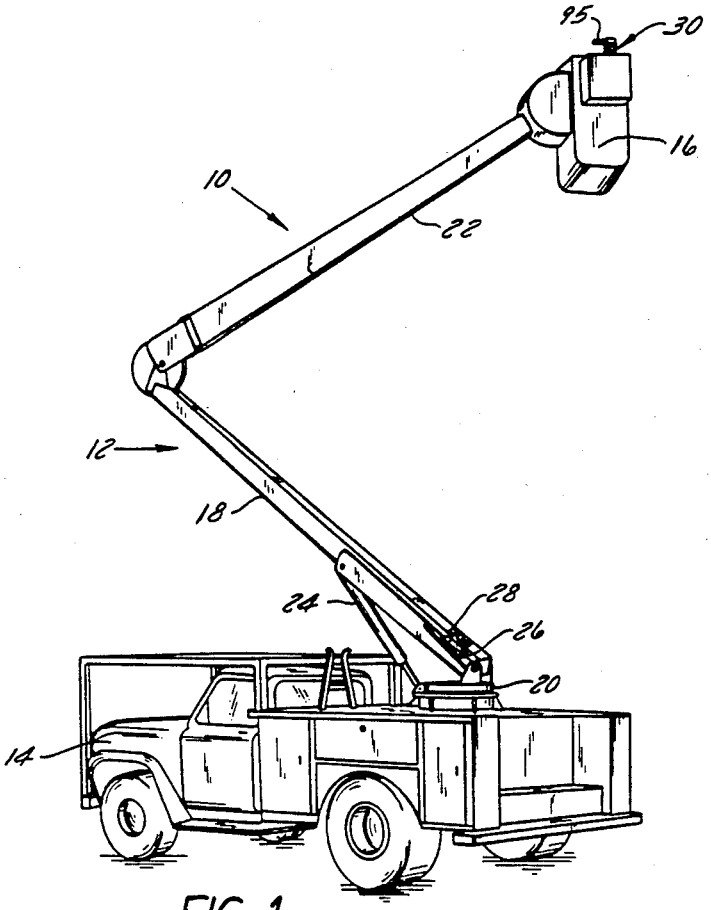
FIG. 1 is a perspective view of an aerial lift embodying the invention and supported by a truck.

Before describing one embodiment of the invention in detail, it is to be understood that the invention is not limited in its application to the details of construction set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF A PREFERRED EMBODIMENT

Illustrated in FIG. 1 is a truck mounted aerial lift 10 of the type including an articulated boom 12 supported by a truck 14 and including a bucket or platform 16 mounted on one end of the articulated boom 12 and adapted to carry an operator. The articulated boom 12 includes a lower boom section 18 supported by a swivel assembly 20 for rotation about a vertical axis, and the lower boom section 18 is pivotally joined to the swivel assembly 20.

The articulated boom 12 also includes an upper boom section 22 pivotally connected to the upper end of the lower boom section 18 and supporting the bucket 16. A first hydraulic cylinder 24 is Provided for causing pivotal movement of the lower boom portion with respect to the swivel assembly 20, and a second hydraulic cylinder (not shown) is provided for causing pivotal movement of the upper boom section 22 with respect to the lower boom section 18. A rotary hydraulic motor (not shown) is provided for causing rotation of the articulated boom 12 about the vertical axis of the swivel assembly 20. Hydraulic control valves 26 are also provided for controlling the operation of the rotary hydraulic motor and the two hydraulic cylinders. As is conventional, the hydraulic control valves 26 are mounted adjacent the base of the articulated boom 12, and a control handle 28 is provided to permit manual control of each hydraulic control valve 26. Means are also mounted in the bucket 16 for permitting the operator in the bucket 16 to control the hydraulic control valves 26, this means including a control handle 30 mounted so as to be conveniently manipulated by the operator, and the control handle 28 being connected by hydraulic fluid lines to the hydraulic control valves 26.

Figure 2:
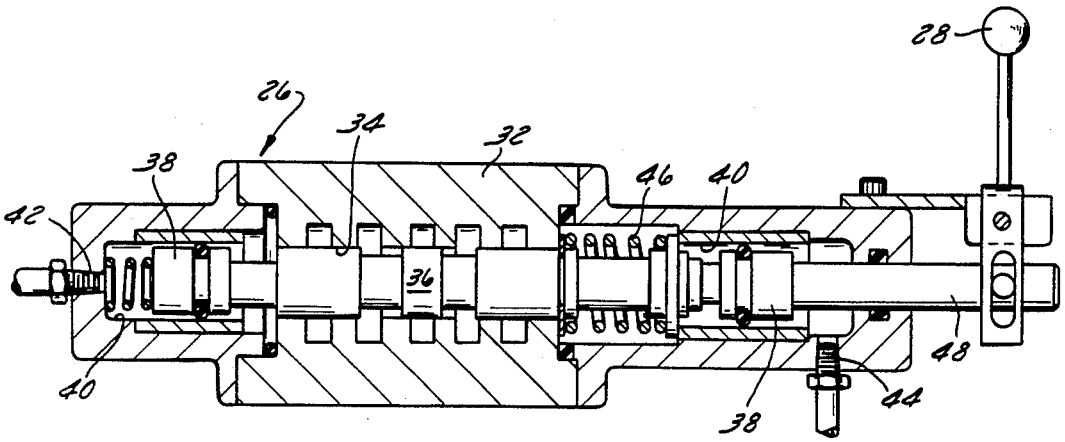
FIG. 2 is an enlarged cross section elevation view of a control valve embodied in the aerial lift illustrated in FIG. 1.

One of the hydraulic control valves 26 is illustrated in FIG. 2 and is representative of the construction of the other control valves. Each control valve 26 includes a body portion 32 having a central bore 34 housing a reciprocable valve spool 36. The opposite ends of the valve spool 36 define Pistons 38 housed in cylinders 40. Hydraulic fluid Ports 42 and 44 admit hydraulic pilot fluid to the cylinders 40 to provide pilot fluid control of the position of the valve spool 36. A centering spring 46 is provided for biasing the valve spool 36 toward a neutral position.

Means are also provided for overriding the pilot fluid control of the valve spool. In the illustrated arrangement the control handle 28 is connected to a valve spool extension 48 and is pivotally connected to the body portion 32 of the valve so as to cause controlled movement of the valve spool 36. The control handles 28 are provided to permit an operator on the ground to have direct manual control over the control valves in the event there is a malfunction of the control 30 in the bucket 16 or in the event the operator otherwise loses control of the bucket 16.

Means are also provided for supplying hydraulic fluid to the control valves 26 and for Providing pilot fluid to the pilot ports 42 and 44 of the control valves to provide for selective controlled operation of the control valves 26. This means for supplying hydraulic fluid to the control valves is illustrated schematically in FIG. 3. For purposes of convenience of illustration and description, only a single control valve 26 is shown, but it should be understood that hydraulic fluid is supplied to the other control valves by hydraulic control systems of the type illustrated in FIG. 3. The illustrated means for supplying hydraulic fluid to the control valves 26 and for controlling operation of the hydraulic control valves includes a hydraulic fluid pump 50 operably connected to the control valves 26. Means are also provided for controlling the pressure of the hydraulic fluid supplied to the control valves. The means for controlling the hydraulic fluid pressure includes a conventional pilot operated unloading valve 52 operably connected to a conventional hydraulic accumulator 54 through a check valve 56. The accumulator 54 can be precharged to approximately 800 p.s.i. The unloading valve 52 is pilot operated and can maintain an oil pressure in the accumulator 54 of between, for example, 1,300 to 1,600 p.s.i. The unloading valve 52 is also connected to a fluid reservoir 58 to return hydraulic fluid to the fluid reservoir. The hydraulic fluid control system also includes a conventional pressure reducing valve 60 adapted, for example, to supply hydraulic fluid at 1,200 p.s.i. to the control valve 26.

Means are also provided for selectively supplying hydraulic fluid pressure to the control valve in response to actuation of a deadman control to be described in greater detail hereinafter. In a preferred form of the invention, the control 30 mounted on the bucket 16 includes a lever adapted to engage a piston of a pneumatic cylinder. The pneumatic cylinder is connected, by an air line extending along the length of the articulated boom from the bucket, to an air pressure responsive electrical switch. The electrical switch selectively emits an electrical signal. When an operator grips the control handle, and when the lever is depressed, the pneumatically actuated electrical switch will send an electrical signal to a solenoid operated deadman valve 62 which will then permit hydraulic fluid to be delivered to the control valve 26. If the lever on the control handle is released, the flow of hydraulic fluid to the control valve 26 is interrupted.

Figure 3:
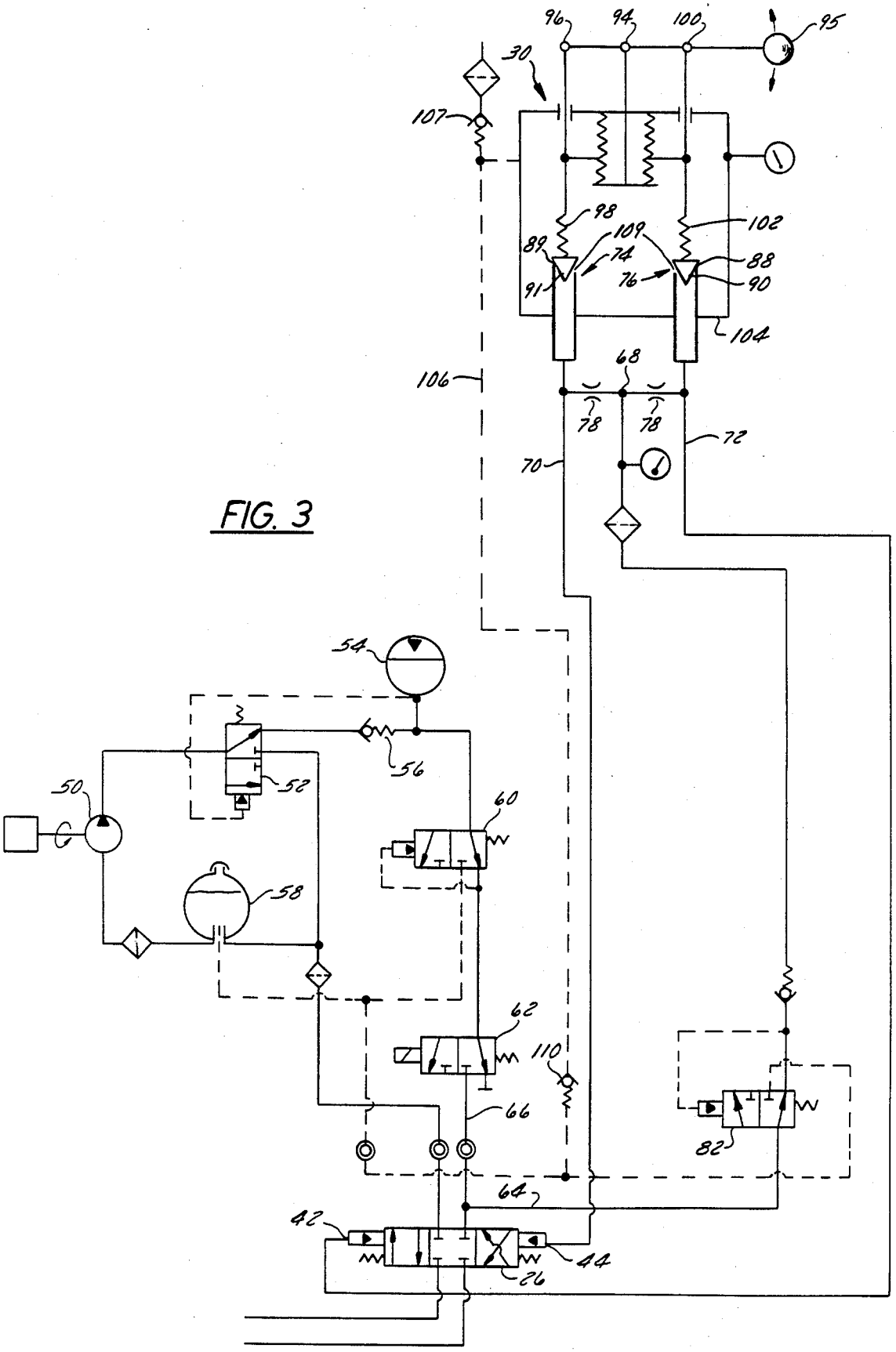
FIG. 3 is a schematic view of a hydraulic circuit of the aerial lift illustrated in FIG. 1.

Means are also provided for hydraulically connecting the control 30 on the bucket 16 to the pilot operated control valves so as to control the operation of the control valves 26. This means for connecting the control 30 to the control valves 26 is schematically illustrated in FIG. 3.

A fluid conduit 64 is connected to the hydraulic fluid supply conduit 66 between the deadman valve 62 and the control valve 26. The fluid conduit 64 supplies hydraulic fluid through a pressure reducing valve 82 to a manifold 68 adjacent the control 30 on the bucket 16. The manifold 68 is connected by conduits 70 and 72 to pilot ports 44 and 42, respectively, of the control valve 26.

Means are also provided for restricting the flow of hydraulic fluid from the fluid conduit 64 and manifold 68 through the conduits 70 and 72. In the illustrated arrangement, the means for restricting fluid flow can comprise a pair of restriction orifices 78, the restriction orifices 78 being balanced such that they allow equal hydraulic fluid flow therethrough if fluid flow through the conduits 70 and 72 is otherwise unrestricted.

The hydraulic circuit for the control handle assembly also includes a restriction orifice 80 for limiting the flow of hydraulic fluid to the manifold 68 and to the control assembly 30.

Means are also provided for selectively venting hydraulic fluid from the conduits 70 and 72 to thereby control hydraulic fluid pressure at the pilot ports 44 and 42. The means for venting includes a pair of fluid relief ports 74 and 76, the fluid relief port 74 including a valve seat 89, and a valve member 91 resiliently biased into engagement with the valve seat 89 by a compression spring 98 and selectively moveable away from the valve seat 89 to vent hydraulic fluid from the hydraulic fluid line 70. The fluid relief port 76 similarly includes a valve seat 88 and a valve member 90 resiliently biased into engagement with the valve seat 88 by a compression spring 102. Hydraulic fluid pressure against the valve member 90 can force the valve member 90 away from valve seat 88 to thereby vent hydraulic fluid from conduit 72.

Means are also provided for supporting the pair of the valve members 90 and 91 such that movement of a control lever 95 from a neutral position can vary the force on the valve members 90 and 91 such that, as the control handle 95 is moved, the force of one of the valve members on its associated valve seat will be decreased and the force of the other of the valve members on its associated valve seat will be increased. The amount of hydraulic fluid vented through one of the relief ports 74 or 76 will be increased and the amount of hydraulic fluid vented through the other relief port will be decreased. This will, in turn, have the effect of controlling the hydraulic fluid pressure at the pilot ports 42 and 44 of the control valves.

More specifically, as illustrated schematically in FIG. 3 the control lever 95 is supported for pivotal or rocking movement about a pivot 94. One end 96 of the control lever 95 is operatively connected through the compression spring 98 to a first one of the valve members 91 and controls movement of that valve members 91 toward and away from the associated valve seat 89, and an opposite end 100 of the control lever 95 is operatively connected through the compression spring 102 to one of the valve members 90 and controls movement of that valve member 90 toward and away from the valve seat 88. When the control handle 95 is caused to pivot about the pivot 94, the force of one of the compression springs 98 or 102 on its associate valve member will increase, and fluid flow through that fluid relief port will decrease, and the force of the other compression spring 98 or 102 on its associated valve member will decrease, and the amount of hydraulic fluid vented through that fluid relief port will increase.

Figure 5:
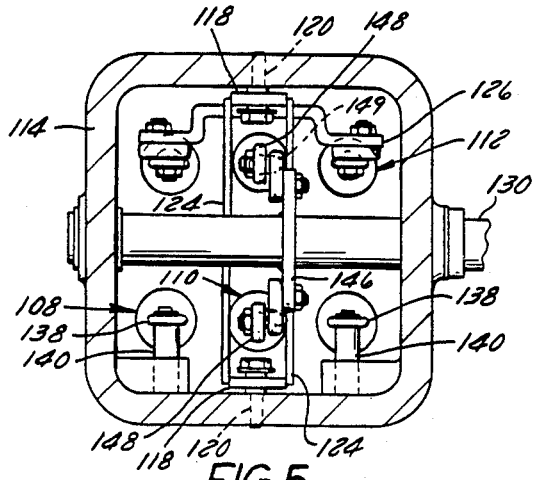
FIG. 5 is a cross section view taken along lines 5—5 in FIG. 4.
Figure 4:
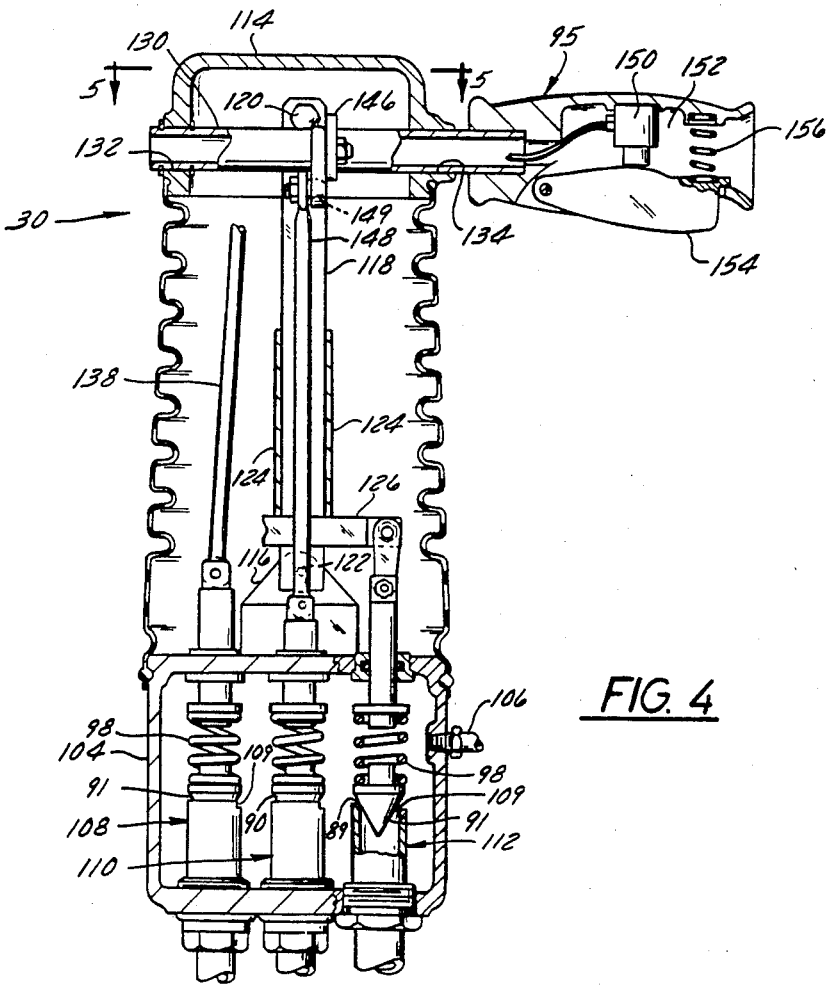
FIG. 4 is an enlarged cross section elevation view of a control handle supported by the bucket of the aerial lift illustrated in FIG. 1.

While the control handle assembly 30 could have other constructions, in one preferred form of the invention the valve members and control handle are arranged as illustrated in FIGS. 4 and 5. The apparatus shown there includes a control handle 95 having a central longitudinal axis and being supported for twisting movement about this longitudinal axis whereby the control handle 95 will cause pivotal movement of the articulated boom about its vertical axis. Means are also provided for supporting the free end of the control handle 95 for movement generally up and down whereby the control handle can control up and down movement of the bucket of the aerial lift. The control handle 95 is also supported for generally linear fore and aft movement with respect to its longitudinal axis, and such that when the control handle is pushed forwardly, the bucket will move forwardly, and when the control handle is pulled rearwardly, it will cause rearward movement of the bucket.

The control handle assembly includes a housing or container 104 defining a closed hydraulic fluid reservoir connected by a fluid discharge line 106 to the hydraulic fluid reservoir 58. The housing 104 is adapted to be fixed to the bucket or basket 16 of the aerial lift 12 and in a Position wherein the control handle 95 is conveniently positioned for access by an operator in the bucket. The hydraulic fluid container 104 houses three pairs of hydraulic fluid relief valves 108, 110, and 112. Each pair of hydraulic fluid relief valves is operably connected to a control valve 26 as illustrated schematically in FIG. 3 and functions in the manner of relief valves 74 and 76 shown there. Each pair of hydraulic fluid relief valves 108, 110, and 112 includes a pair of relief ports 88 and 89 operably connected to pilot ports of a control valve 26, and valve members 90 and 91 as illustrated in FIG. 3 moveable toward and away from valve seats 88 and 89, respectively, of the relief ports. The valve members 90 and 91 are resiliently biased into engagement with the valve seats 88 and 89 by compression springs 102 and 98, respectively.

Means are also provided for permitting controlled flow of hydraulic fluid through the valves 108, 110 and 112 when the valve members are in engagement with the valve seats. This means comprises a small gap or notch 109 in either the valve seat or the valve member of each valve. During operation of the control systems, a small controlled quantity of hydraulic fluid can be vented through the notches 109. Additionally, the hydraulic fluid in the housing or reservoir 104 will be maintained at a level above the valve seats 88 and 89. If there is leakage of hydraulic fluid from the fluid lines 70 and 72, fluid can flow through the gaps from the reservoir 104 into the fluid lines 70 and 72, thereby preventing formation of vacuum in fluid lines 70 and 72.

It is important to prevent formation of a vacuum in the hydraulic lines 70, 72 and 106 in order to maintain the electrical isolation of the aerial lift bucket. If a vacuum forms in the fluid lines, the fluid lines will function as electrically conductive conduits. If the fluid lines are filled with hydraulic fluid or air, the fluid lines are not electrically conductive. In the use of aerial lifts having long booms, if there is a leak in the hydraulic lines at the base of the boom, the weight of the hydraulic fluid in the lines may draw a vacuum in the fluid lines causing them to be electrically conductive.

In the illustrated arrangement the hydraulic fluid discharge line 106 includes check valves 107 and 110. Check valve 107 is functional to Permit air flow into the fluid discharge line 106 to also prevent formation of a vacuum in the discharge line 106.

In the illustrated construction, the control handle assembly also includes a cup-shaped cap 114 which is pivotally supported by a pair of upwardly extending spaced apart lugs 116 and a pair of spaced apart parallel and upwardly extending links 118 preferably made of rigid bar stock. The upper ends of these links are pivotally secured by bolts 120 to opposite sides of the cap 114, and the lower ends of the links 118 are pivotally joined to the upwardly extending lugs by bolts 122. Two plates 124 are secured to the two links 118 and are positioned on opposite sides of the links 118 to provide rigidity to the links and to insure pivotal movement of the links as a unit.

A rocker arm 126 is fixedly secured to the links 118 adjacent the location where the lower ends of the links 118 are pivotally joined to the upwardly projecting lugs 116, and the rocker arm 126 includes opposite ends projecting outwardly from the links 118. One of these opposite ends of the rocker arm 126 is connected to a first valve member 91 and the other end of the rocker arm 126 is connected to a complementary second valve member 90 (not shown). When the links 118 are moved such that they pivot about the pivot axis of bolt 122 where the lower ends of the links 118 are joined to the upwardly extending lugs 116, the rocker arm 126 will cause one of the valve members 91 and 90 to be forced downwardly against its associated valve seat, and the other of the valve members will be pulled upwardly away from its associated valve seat. Such pivotal movement of the rocker arm 126 is caused by moving the control handle 95 forwardly or rearwardly with respect to the supporting structure of the control handle.

Means are also provided for controlling a second pair of relief valve members 89 and 91 in response to up and down movement of the control handle 95. The control handle 95 is supported by a shaft 130 extending through bores 132 and 134 in the cap 114. The bolts 120 extending through the upper ends of the links 118 support the cap 114 such that it is pivotally moveable about a horizontal axis extending through the upper ends of the links 118 and Perpendicular to the longitudinal axis of the control handle 95. Accordingly, up and down movement of the control handle 95 causes pivotal movement of the cap 114 about the axis of the bolts 120.

A pair of spaced apart vertically extending links 138 are connected at their upper ends by pins 140 to the cap 114. One of the vertically extending links 138 is connected by a pin 140 to the cap on one side of the pivot axis of the cap, and an upper end of the other vertically extending link 138 or connecting rod is connected by a pin 140 to the cap on an opposite side of the pivot axis of the cap. The lower end of one of the links 138 is connected to a first valve member 91 of the second pair of relief valves 108, and the lower end of the other one of the links 138 is connected to a second valve member 90 of the second pair of relief valves. Vertical movement of the control handle 95 and consequent pivoting movement of the cap 114 about the axis of the pins 120 will thus cause vertical movement of the vertical links 138 and vary the force applied by the compression springs 98 and 102 on the valve members of the second pair of valve members 90 and 91, respectively.

Means are further provided for varying the force on valve members 90 and 91 of a third set of relief valves 110 in response to rotation of the control handle 95 about its longitudinal axis. The control handle 95 and the shaft 130 are supported in the bores 132 and 134 for rotation about their longitudinal axis with respect to the cap 114. A rocker arm or lever 146 is fixed to the shaft 130 and includes opposite ends projecting radially outwardly from the shaft 130. A first vertical link or connecting rod 148 has an upper end connected by a ball joint 149 to one end of the rocker arm 146 and a lower end connected to a valve member 90 of a third pair of relief valves. A second vertical link 148 has an upper end connected to the opposite end of the rocker arm 146 and a lower end connected to a second valve member 91 of the third pair of relief valves. In operation, when the control handle 95 is twisted about its longitudinal axis, the first vertical link will either increase or decrease the downward force of the associated valve member against the valve seat, and the second vertical link will cause an opposite change in the force on the other valve member of the third pair of relief valves.

The control handle 95 also includes a pneumatic cylinder 150 connected by an air line to a Pressure responsive electrical switch (not shown) at the base of the articulated boom. The pressure responsive switch is in turn electrically connected to the solenoid operated deadman valve 62. In the illustrated arrangement, the pneumatic cylinder is housed within a cavity 152 within the control handle. A pivotal lever 154 is selectively engageable with a piston of the pneumatic cylinder 150. A compression spring 156 is provided to bias the lever 152 away from the piston of the pneumatic cylinder 150.

In operation of the deadman control, when the operator grips the control handle 95, the lever 152 will engage the piston of the pneumatic cylinder 150. The solenoid operated valve 62 will then function to permit hydraulic fluid flow to the control valve 26 and hydraulic fluid flow to the control handle assembly 30. When the operator, releases the control handle 95, the compression spring 156 will force the lever 152 away from the Piston, and the solenoid operated valve 62 will interrupt the flow of hydraulic fluid to both the control valve 26 and to the control handle assembly 30.

Various features of the invention are set forth in the following claims.

I claim:

1. An aerial lift comprising:

a base, an elongated boom supported by said base and including a free end, a fluid motor operably connected to said elongated boom, means for supplying hydraulic fluid to said fluid motor, said means for supplying hydraulic fluid including a hydraulic fluid pump operably connected to said fluid motor, and means for controlling the supply of hydraulic fluid from said hydraulic fluid pump to said fluid motor, said means for controlling including a pilot operated control valve having a first pilot fluid port and a second pilot fluid port, means for supplying pilot hydraulic fluid pressure to said first pilot fluid port and to said second pilot fluid port of said pilot operated control valve to control operation of said pilot operated control valve, said means for supplying pilot hydraulic fluid pressure including a first hydraulic fluid conduit operably connecting said hydraulic fluid pump to said first pilot fluid port of said control valve, and a second hydraulic fluid conduit operably connecting said hydraulic fluid pump to said second pilot fluid port of said control valve, and means for selectively venting hydraulic fluid from said first fluid conduit and said second fluid conduit, said means for selectively venting hydraulic fluid from said first fluid conduit including a first valve seat and a first valve member selectively engageable with said first valve seat and movable toward and away from said first valve seat, at least one of said first valve member and said first valve seat including notch means defining a first fluid port when said first valve member engages said first valve seat and said first valve seat and first valve member providing for increased fluid flow from said first fluid conduit when said first valve member moves away from said first valve seat, and said means for selectively venting hydraulic fluid from said second fluid conduit includes a second valve seat and a valve member selectively engageable with said second valve seat and moveable away from said second valve seat, at least one of said said second valve member and said second valve seat including notch means defining a fluid port when said second valve member engages said second valve seat and said second valve member and said second valve seat providing for increased fluid flow from said second fluid conduit when said second valve member moves away from said second valve seat.

2. An aerial lift as set forth in claim 1 wherein said means for selectively venting includes a first spring means for biasing said first valve member toward engagement with said first valve seat, and a second spring means for biasing said second valve member into engagement with said second valve seat.

3. An aerial lift as set forth in claim 2 wherein said means for selectively venting includes a control member supported for shiftable movement between a neutral position, a first position and a second position, said control member being connected to said first spring means and to said second spring means for controlling the force of said first spring means on said first valve member and for controlling the force of said second spring means on said second valve member.

4. An aerial lift as set forth in claim 3 wherein said control member is a control lever supported for pivotal movement about a pivot axis, and wherein said first spring means is connected to said control lever on one side of said pivot axis and said second spring means is connected to said control lever on an opposite side of said pivot axis.

5. An aerial lift as set forth in claim 4 wherein said first spring means comprises a first compression spring positioned between a first portion of said control lever on one side of pivot axis and said first valve member for resiliently biasing said first valve member toward said first valve seat, and wherein said second spring means comprises a second compression spring positioned between a second portion of said control lever on said opposite side of said pivot axis and said second valve member for resiliently biasing said second valve member toward said second valve seat.

6. An aerial lift as set forth in claim 2 wherein said means for supplying pilot hydraulic fluid pressure to said first pilot fluid port and to said second pilot fluid port includes a first fluid flow restriction in said first fluid conduit between said hydraulic fluid pump and said first fluid relief port and a second fluid flow restriction in said second fluid conduit between said hydraulic fluid pump and said second fluid relief port.

7. An aerial lift as set forth in claim 1 wherein said aerial lift further includes a second pilot operated control valve having a first pilot fluid port and a second pilot fluid port, and a third pilot operated control valve having a first pilot fluid port and second pilot fluid port, wherein said pilot operated control valves are supported adjacent said base, and wherein said means for selectively venting includes a control handle supported by said free end of said boom arm, said control handle being shiftably movable in a first direction to selectively control hydraulic fluid pressure supplied to said first pilot port and said second pilot port of said pilot operated control valve, said control handle being shiftably movable in a second direction transverse to said first direction to selectively control hydraulic fluid pressure supplied to said first pilot port and said second pilot port of said second pilot operated control valve, and said control handle having a longitudinal axis, said control handle being rotatable about said longitudinal axis to selectively control hydraulic fluid pressure at said first pilot port and said second pliot port of said third pilot operated control valve.

8. An aerial lift as set forth in claim 1 wherein said means for supplying hydraulic fluid to said extensible fluid motor further includes a hydraulic fluid pressure accumulator operably connected to said hydraulic fluid pump, a pilot operated fluid pressure relief valve operably connected between said hydraulic fluid pressure accumulator and said hydraulic fluid pump, and a pressure reducing valve operably connected between said hydraulic fluid pressure accumulator and said pilot operated control valve.

9. A aerial lift as set forth in claim 1 and further including a hydraulic fluid resevoir, the hydraulic fluid resevoir housing said first valve seat and said first valve member and housing said second valve seat and said second valve member, and said hydraulic fluid resevoir containing hydraulic fluid, the level of hydraulic fluid in the resevoir being above the first valve seat and the second valve seat.

10. Apparatus for use in controlling the operation of a pilot operated hydraulic control valve including a valve body housing a reciprocably movable valve spool, and the hydraulic valve body including a first fluid port and a second fluid port, a first pilot fluid port at one end of the valve housing for supplying pilot hydraulic fluid to one end of the valve spool and a second pilot fluid port at an opposite end of the valve housing for supplying pilot hydraulic fluid to an opposite end of the valve spool, and including a hydraulic fluid pump operably connected to at least one of said first fluid port and said second fluid port, the apparatus for controlling comprising:

means for supplying pilot hydraulic fluid pressure to said first pilot fluid port and to said second pilot fluid port of said pilot operated control valve to control operation of said pilot operated control valve, said means for supplying pilot hydraulic fluid pressure including a first hydraulic fluid conduit operably connecting said hydraulic fluid pump to said first pilot fluid port of said control valve, and a second hydraulic fluid conduit operably connecting said hydraulic fluid pump to said second pilot fluid port of said contol valve, and means for selectively venting hydraulic fluid from said first fluid conduit and said second fluid conduit, said means for selectively venting including a first valve seat and a first valve member selectively engageable with said valve seat and movable toward and away from said first valve seat to control the amount of hydraulic fluid vented from said first fluid conduit and a first valve seat, one of said first valve member and said first valve seat including notch means defining a first fluid port when said first valve member engages said first valve seat, and spring means for biasing said first valve member toward engagement with said first valve seat, and a second valve seat and a second valve member movable toward and away from said second valve seat to control the amount of hydraulic fluid vented from said second fluid conduit, at least one of and said second valve seat and said second valve member including notch means defining a second fluid port when said second valve member engages said second valve seat, and a second spring means for biasing said second valve member into engagement with said second valve seat.

11. Apparatus as set forth in claim 10 wherein said means for selectively venting includes a control member supported for shiftable movement between a neutral position, a first position and a second position, said control means being connected to said first spring means and to said second spring means.

12. Apparatus as set forth in claim 11 wherein said control member is a control lever supported for pivotal movement about a pivot axis, and wherein said first spring means is connected to said control lever on one side of said pivot axis and said second spring means is connected to said control lever on an opposite side of said pivot axis.

13. Apparatus as set forth in claim 12 wherein said first spring means comprises a first compression spring positioned between a first portion of said control lever on said one side of pivot axis and said first valve member for resiliently biasing said first valve member toward said first valve seat, and wherein said second spring means comprises a second compression spring positioned between a second portion of said control lever on said opposite side of said pivot axis and said second valve member for resiliently biasing said second valve member toward said second valve seat.

14. Apparatus as set forth in claim 10 wherein the means for supplying pilot hydraulic fluid pressure to said first pilot fluid port and to said second pilot fluid port further includes a hydraulic fluid resevoir, the hydraulic fluid resevoir housing said first valve seat and said first valve member and housing said second valve seat and said second valve member, and said hydraulic fluid resevoir containing hydraulic fluid, the level of hydraulic fluid in the resevoir being above the first valve seat and the second valve seat.

* * * * *